US011594834B2

(12) United States Patent
Racho

(10) Patent No.: US 11,594,834 B2
(45) Date of Patent: Feb. 28, 2023

(54) ELECTRICAL CONNECTOR ASSEMBLY

(71) Applicant: Lear Corporation, Southfield, MI (US)

(72) Inventor: Edgar Michael Racho, Lapu-Lapu (PH)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/863,414

(22) Filed: Apr. 30, 2020

(65) Prior Publication Data

US 2021/0344134 A1 Nov. 4, 2021

(51) Int. Cl.
*H01R 13/40* (2006.01)
*H01R 13/424* (2006.01)
*H01R 13/50* (2006.01)

(52) U.S. Cl.
CPC ..... *H01R 13/424* (2013.01); *H01R 13/501* (2013.01)

(58) Field of Classification Search
CPC ..... H01R 13/424; H01R 13/42; H01R 13/40; H01R 13/501; H01R 13/50; H01R 13/46
USPC ..... 439/709
See application file for complete search history.

(56) References Cited

U.S. PATENT DOCUMENTS 3,715,706 A * 2/1973 Michel ..... H01R 12/714 439/493
3,920,303 A 11/1975 Pittman et al.
4,060,295 A * 11/1977 Tomkiewicz ..... H01R 12/83 439/55
4,245,876 A * 1/1981 Ritchie ..... H01R 12/7082 439/590
4,358,173 A * 11/1982 Conrad ..... H01R 12/62 439/67
4,623,207 A * 11/1986 Sasaki ..... H01R 12/7082 439/59
4,695,112 A * 9/1987 Maston ..... H01R 12/79 439/328
4,715,826 A * 12/1987 Collier ..... H01R 12/83 439/329
4,747,790 A * 5/1988 Masuda ..... H01R 12/83 439/326
5,035,641 A * 7/1991 Van-Santbrink ... H01R 12/7023 439/329
5,057,032 A * 10/1991 Kaufman ..... H01R 12/721 439/326

(Continued)

*Primary Examiner* — Harshad C Patel
(74) *Attorney, Agent, or Firm* — MacMillan, Sobanski & Todd, LLC

(57) ABSTRACT

An electrical connector assembly that can quickly and easily be secured to two electrically conductive structures, such as a flat flexible conductor having multiple electrically conductive traces and a printed circuit board having multiple electrically conductive traces, without the use of specialized tools and/or methods is disclosed. The electrical connector assembly includes a housing having a plurality of slots defined therein. An electrical contact is disposed within each of the plurality of slots. Each electrical contact includes a first portion engaged with the housing, a second portion adapted to engage the first electrically conductive structure when inserted within the housing, and an intermediate portion located between the first portion and the second portion and adapted to engage the second electrically conductive structure when inserted within the housing.

18 Claims, 4 Drawing Sheets

(56) References Cited

U.S. PATENT DOCUMENTS

| | | | | | |
|---|---|---|---|---|---|
| 5,484,295 | A * | 1/1996 | Mowry | H01R 12/52 | 439/65 |
| 6,116,957 | A * | 9/2000 | Mickievicz | H01R 12/721 | 439/631 |
| 6,176,737 | B1 * | 1/2001 | Choy | H01R 13/6456 | 439/541.5 |
| 6,312,263 | B1 * | 11/2001 | Higuchi | H01R 13/2435 | 439/66 |
| 6,991,472 | B2 * | 1/2006 | Du | H01R 13/2435 | 439/66 |
| 7,537,458 | B2 * | 5/2009 | Idzik | H01R 4/02 | 439/65 |
| 7,955,112 | B2 * | 6/2011 | Yang | H01R 12/7023 | 439/328 |
| 8,062,071 | B2 * | 11/2011 | Yamakami | H01R 13/514 | 439/631 |
| 8,292,667 | B1 * | 10/2012 | Huang | G06K 7/0021 | 439/630 |
| 8,425,252 | B2 * | 4/2013 | Cai | H01R 12/721 | 439/541.5 |
| 8,449,322 | B2 * | 5/2013 | Cai | H01R 13/2492 | 439/541.5 |
| 8,449,334 | B2 * | 5/2013 | Wang | H01R 12/721 | 439/630 |
| 2002/0168900 | A1 * | 11/2002 | Chen | G06K 7/0073 | 439/630 |
| 2004/0132319 | A1 * | 7/2004 | Richter | H01R 12/716 | 439/66 |

* cited by examiner

ELECTRICAL CONNECTOR ASSEMBLY

BACKGROUND OF THE INVENTION

This invention relates in general to electrical connector assemblies that facilitate mechanical and electrical connections between two electrically conductive structures. In particular, this invention relates to an improved structure for such an electrical connector assembly that can quickly and easily be secured to two electrically conductive structures, such as a flat flexible conductor having multiple electrically conductive traces and a printed circuit board having multiple electrically conductive traces, without the use of specialized tools and/or methods.

Many electrical systems are known in the art that include one or more electrically operated devices. For example, most automobiles and other vehicles include a variety of electrically operated devices that can be selectively operated for the comfort and convenience of a driver or an occupant. Typically, each of these electrically operated devices is connected to a source of electrical energy (and/or other components of the electrical system) by one or more electrical conductors. In many instances, electrical connector assemblies are provided for facilitating the installation, service, and removal of these electrically operated devices to and from the electrical system.

A typical electrical connector assembly includes an outer housing (which is usually formed from an electrically non-conductive material) and an inner electrical terminal (which is usually formed from an electrically conductive material) that is supported within the housing. The housing usually has first and second openings extending therethrough, and the electrical terminal is supported within the housing adjacent to those first and second openings. The first opening facilitates the passage of a first electrically conductive structure through the housing into engagement with the electrical terminal supported therein. The second opening facilitates the passage of a second electrically conductive structure through the housing into engagement with the electrical terminal supported therein.

In the past, the connections of the electrical connector assembly to either or both of the first and second electrically conductive structures have been accomplished using a variety of specialized tools and/or specialized methods. Although effective, it has been found that the use of known specialized tools and/or methods are relatively time-consuming and complicated. Thus, it would be desirable to provide an improved structure for such an electrical connector assembly that can quickly and easily be secured to two electrically conductive structures, such as a flat flexible conductor having multiple electrically conductive traces and a printed circuit board having multiple electrically conductive traces, without the use of specialized tools and/or methods.

SUMMARY OF THE INVENTION

This invention relates to an improved structure for an electrical connector assembly that can quickly and easily be secured to two electrically conductive structures, such as a flat flexible conductor having multiple electrically conductive traces and a printed circuit board having multiple electrically conductive traces, without the use of specialized tools and/or methods. The electrical connector assembly includes a housing having a plurality of slots defined therein. An electrical contact is disposed within each of the plurality of slots. Each electrical contact includes a first portion engaged with the housing, a second portion adapted to engage the first electrically conductive structure when inserted within the housing, and an intermediate portion located between the first portion and the second portion and adapted to engage the second electrically conductive structure when inserted within the housing.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
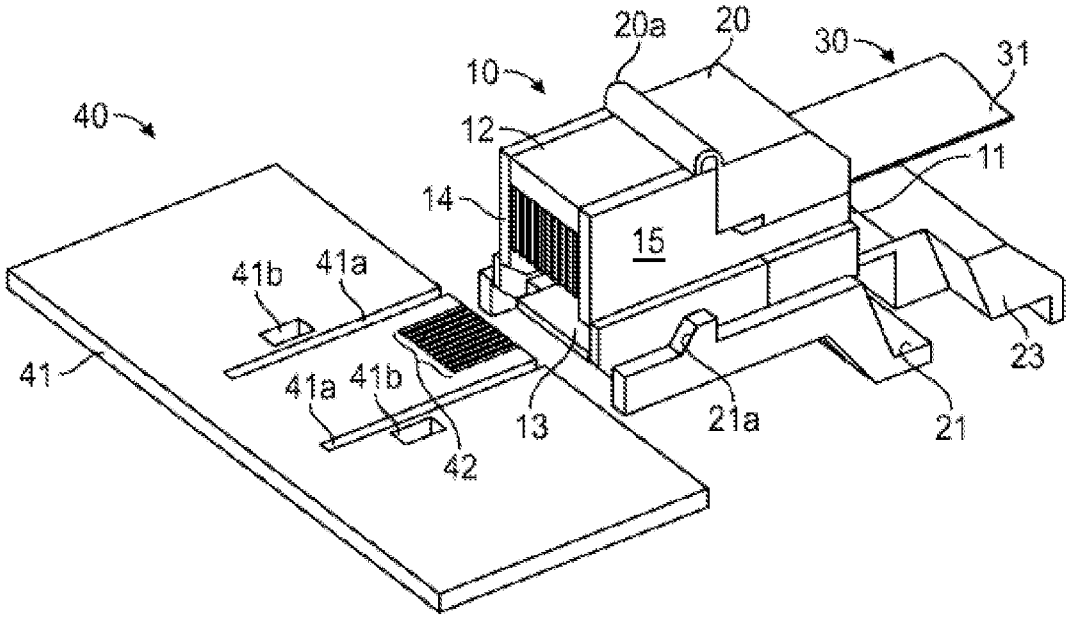
FIG. 1 is an exploded perspective view of an electrical connector assembly in accordance with this invention, a first electrically conductive structure shown assembled with the electrical connector assembly, and a second electrically conductive structure shown prior to assembly with the electrical connector assembly.
Figure 2:
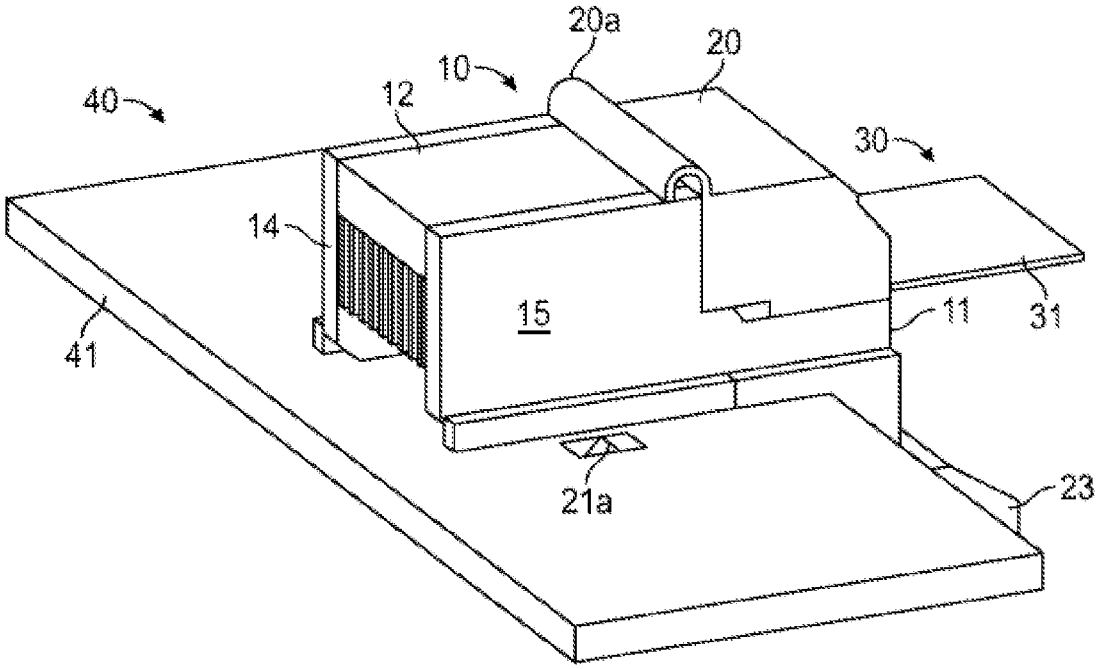
FIG. 2 is a perspective view similar to FIG. 1 showing the electrical connector assembly and the first electrically conductive structure after being assembled with the second electrically conductive structure.

Referring now to the drawings, there is illustrated in FIGS. 1 and 2 an electrical connector assembly, indicated generally at 10, in accordance with this invention, together with portions of a first electrically conductive structure, indicated generally at 30, and a second electrically conductive structure, indicated generally at 40. As will be explained in detail below, the electrical connector assembly 10 is adapted to be connected to both the first electrically conductive structure 30 and the second electrically conductive structure 40 so as to provide an electrical connection therebetween. For example, the first electrically conductive structure 30 may be connected to a source of electrical energy (not shown), and the second electrically conductive structure 40 may be connected to an electrically actuated device (not shown). However, the electrical connector assembly 10 of this invention may be used in any desired environment for any desired purpose.

The electrical connector assembly 10 includes a housing, indicated generally at 11, that is preferably formed from an electrically non-conductive material, such as plastic, although any desired material may be used. The illustrated housing 11 is generally rectilinear in shape and includes an upper panel 12, a lower panel 13, a left panel 14, and a right panel 15 that together define an interior space. However, the housing 11 of the electrical connector assembly 10 may have any desired shape. The housing 11 also includes an interior panel 16 (shown in FIGS. 3 through 8) that extends laterally from the left panel 14 to the right panel 15. In the illustrated embodiment, the interior panel 16 has a generally L-shaped cross sectional shape, although such is not required. Lastly, the housing 11 includes a support surface 17 (also shown in FIGS. 3 through 8) having one or more retainers 18 provided thereon. In the illustrated embodiment, the retainers 18 are generally cylindrical in shape, although again such is not required. The purposes for the interior panel 16, the support surface 17, and the retainers 18 will be explained below.

A plurality of dividers 19 is provided within the interior space of the housing 11. As shown in FIGS. 1 and 2, nine of such dividers 19 are formed integrally with the housing 11 and extend downwardly from the upper panel 12, although such is not required. Together with the left panel 14 and the right panel 15, the dividers 19 separate the interior space of the housing 11 into ten adjacent and parallel slots. However, if desired, a greater or lesser number of such dividers 19 may be provided to separate the interior space of the housing 11 into a greater or lesser number of such slots. The purposes for the dividers 19 and the slots defined thereby will be explained in detail below.

A locking arm 20 is also provided on the housing 11. In the illustrated embodiment, the locking arm 20 is formed integrally with a living hinge 20*a* that is also formed integrally with the housing 11. Thus, the illustrated locking arm 20 is supported on the housing 11 for pivoting movement relative thereto between an unlocked position (illustrated in FIGS. 3 and 6) and a locked position (illustrated in FIGS. 4, 5, 7, and 8). However, the locking arm 20 may be supported on the housing 11 or otherwise provided in any desired manner. An optional retention plate 21 is secured to the lower panel 13 of the housing 11 and includes one or more projections 21*a*. The purposes for the locking arm 20, the retention plate 21, and the projections 21*a* will also be explained in detail below.

The electrical connector assembly 10 also includes one or more electrical contacts, each indicated generally at 22. Preferably, the number of such electrical contacts 22 is the same as the number of slots provided in the housing 11 of the electrical connector assembly 10. Thus, in the illustrated embodiment, the electrical connector assembly 10 includes ten of such electrical contacts 22. However, a greater or lesser number of such electrical contacts 22 may be provided. As best shown in FIGS. 3 through 8, each of the electrical contacts 22 includes a first contact portion 22*a* and a second contact portion 22*b* that are connected by an intermediate contact portion 22*c*. The purposes for the electrical contacts 22 will be explained in detail below.

The illustrated electrical connector assembly 10 further includes a connector position assurance mechanism 23. The connector position assurance mechanism 23 is conventional in the art and, therefore, forms no part of this invention. The connector position assurance mechanism 23 is movable from an unlocked position (illustrated in FIG. 1) to a locked position (illustrated in FIG. 2). For the sake of clarity, the connector position assurance mechanism 23 is not shown in FIGS. 3 through 8. The purpose for the connector position assurance mechanism 23 will be explained below.

The illustrated first electrically conductive structure 30 is a flat flexible conductor 31 that is conventional in the art and includes one or more electrically conductive traces 32 (one of which can be seen in each of FIGS. 3 through 8) that are surrounded by an outer electrically non-conductive insulator 33. Preferably, the number of such electrically conductive traces 32 is the same as the number of slots provided in the housing 11 of the electrical conductor assembly 10. Thus, in the illustrated embodiment, the flat flexible conductor 31 includes ten of the electrically conductive traces 32. However, the flat flexible conductor 31 may include a greater or lesser number of such electrically conductive traces 32 if desired. For a reason that will become apparent below, a portion of the electrically non-conductive insulator 33 is removed adjacent to an end of the flat flexible conductor 31 so as to expose the electrically conductive traces 32. Optionally, one or more openings 34 are formed through the flat flexible conductor 31, for a purpose that will be explained below. The illustrated flat flexible conductor 31 is intended to be representative of any conventional type of electrical conductor and thus, of itself, forms no part of this invention.

The illustrated second electrically conductive structure 40 is a printed circuit board 41 that is also conventional in the art. The illustrated printed circuit board 41 has a pair of slots 41*a* extending inwardly from an edge thereof, for a purpose that will be explained below. Optionally, one or more openings 41*b* are formed in or through the printed circuit board 41, for a purpose that will be also explained below. Also, the printed circuit board 41 includes one or more electrically conductive traces 42. Preferably, the number of such electrically conductive traces 42 provided on the printed circuit board 41 is the same as the number of slots provided in the housing 11 of the electrical conductor assembly 10. Thus, in the illustrated embodiment, the printed circuit board 41 includes ten of such electrically conductive traces 42. However, the printed circuit board 41 may include a greater or lesser number of such electrically conductive traces 42 if desired. The illustrated printed circuit board 41 is also intended to be representative of any conventional type of electrical conductor and thus, of itself, forms no part of this invention.

Figure 3:
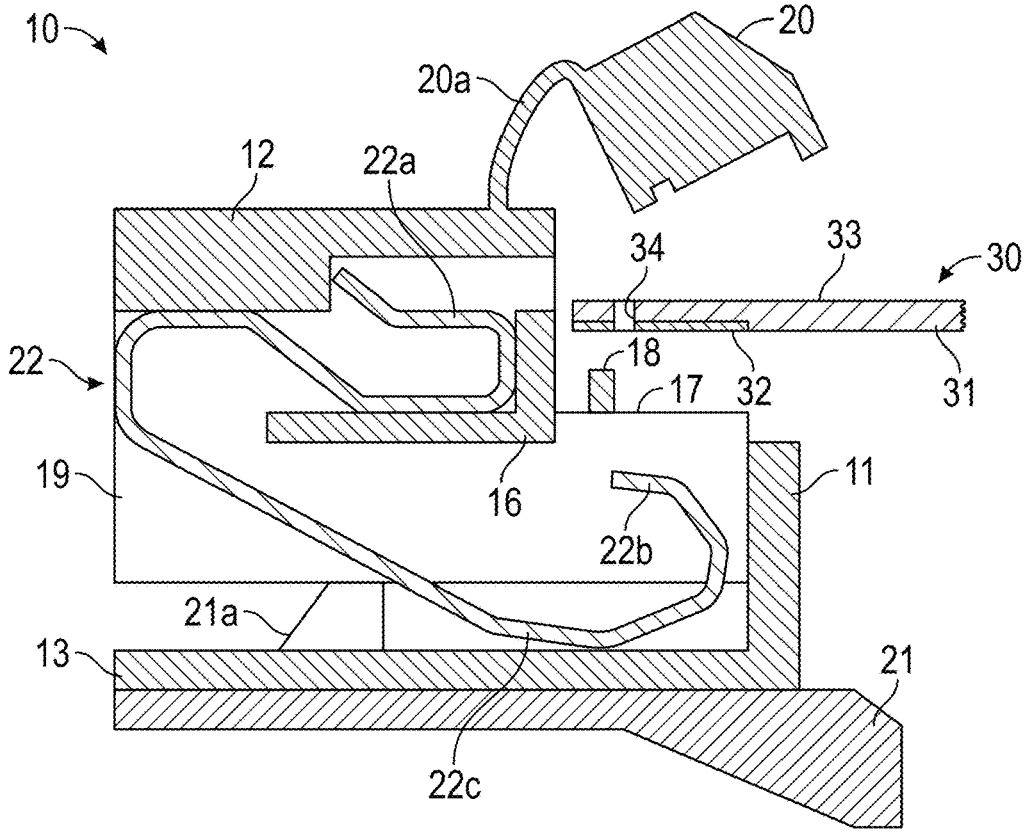
FIG. 3 is a side sectional elevational view of a first embodiment of the electrical connector assembly illustrated in FIGS. 1 and 2 shown in an initial stage of assembly.

As shown in FIG. 3, each of the electrical contacts 22 is initially inserted into an associated one of the slots provided in the interior space of the housing 11. When so inserted, the first contact portion 22*a* of the electrical contact 22 is received within a space defined between the upper panel 12 and the interior panel 16 of the housing 11. If desired, an end of the first contact portion 22*a* may be sized and shaped to abut a portion of the upper panel 12 so as to positively retain the electrical contact 22 within the interior of the housing 11 following insertion, although such is not required. In the first embodiment of this invention, the intermediate contact portion 22*c* of the electrical contact 22 abuts an upper surface of the lower panel 13 of the housing 11 when inserted within the interior of the housing 11. The second contact portion 22*b* of the electrical contact 22 extends adjacent to the retainer 18, but below the level of the support surface 17 of the housing 11.

Figure 4:
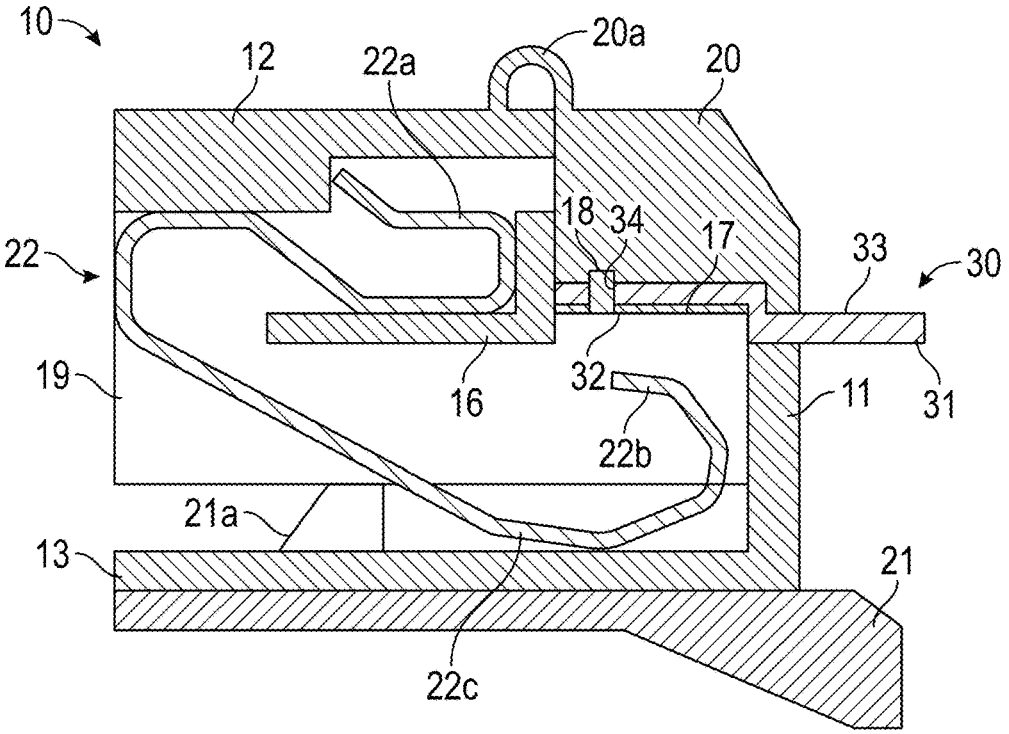
FIG. 4 is a side sectional elevational view of the first embodiment of the electrical connector assembly illustrated in FIG. 3 shown in an intermediate stage of assembly.
Figure 5:
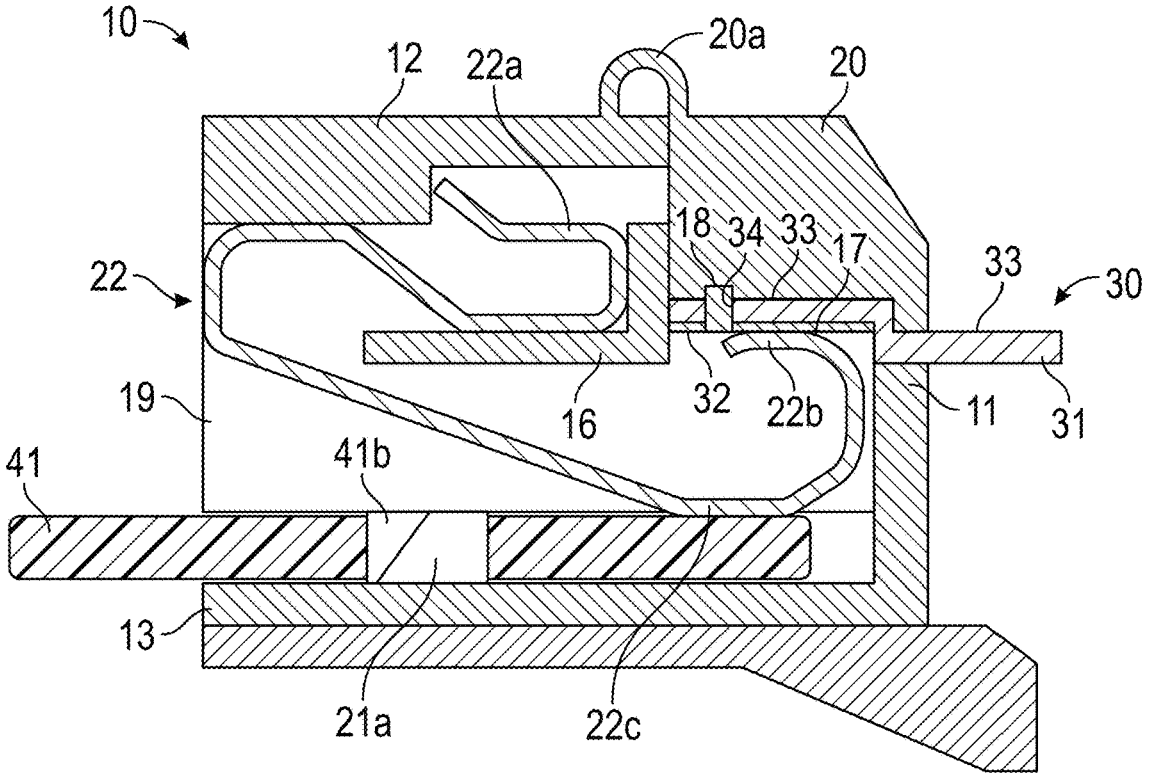
FIG. 5 is a side sectional elevational view of the first embodiment of the electrical connector assembly illustrated in FIG. 4 shown in a final stage of assembly.

FIGS. 3, 4, and 5 illustrate a first embodiment of the electrical connector assembly 10 of this invention in various stages of assembly with the first electrically conductive structure 30 and the second electrically conductive structure 40. Initially, the locking arm 20 of the housing 11 is positioned in the unlocked position, as shown in FIG. 3. Also, the connector position assurance mechanism 23 is initially disposed in the unlocked position shown in FIG. 1. Then, an end of the first electrically conductive structure 30 is disposed adjacent to the support surface 17 and the retainer 18 of the electrical connector assembly 10, as also shown in FIG. 3. In this initial orientation, the opening 34 formed through the flat flexible conductor 31 is preferably aligned with the retainer 18 provided on the electrical connector assembly 10.

Then, as shown in FIG. 4, the end of the flat flexible conductor 31 is moved downwardly into engagement with the support surface 17 provided on the housing 11 of the electrical connector assembly 10. To accomplish this, the flat flexible conductor 31 is moved such that the opening 34 formed therethrough is disposed about the retainer 18 provided on the support surface 17 of the housing 11. Thereafter, the locking arm 20 is moved from the unlocked position to the locked position, as also shown in FIG. 4. Cooperating locking structures (not shown) may be provided on the locking arm 20 and the housing 11 to retain the locking arm 20 in the locked position, although such is not required. When located in this locked position, the locking arm 20 positively retains the flat flexible conductor 31 in engagement with the electrical connector assembly 10.

At this intermediate stage of assembly of the first embodiment, the second portion 22*b* of the electrical contact 22 is spaced apart from the electrically conductive trace 32 provided on the flat flexible conductor 31. Therefore, no electrically conductive connection is yet provided between the second portion 22*b* of the electrical contact 22 and the electrically conductive trace 32 provided on the flat flexible conductor 31.

Next, as shown in FIG. 5, the edge of the printed circuit board 41 is inserted within the housing 11 of the electrical connector assembly 10. To accomplish this, the left panel 14 and the right panel 15 of the housing 11 are respectively inserted within the slots 41*a* provided in the edge of the printed circuit board 41. When the printed circuit board 41 has been fully inserted within the housing 11, the projections 21*a* provided on the retention plate 21 are received within the openings 41*b* formed through the printed circuit board 41, as shown in FIGS. 1 and 5. Lastly, the connector position assurance mechanism 23 is moved from the unlocked position shown in FIG. 1 to the locked position shown in FIG. 2. As a result, the housing 11 of the electrical connector assembly 10 is positively retained on the printed circuit board 41.

As the printed circuit board 41 is inserted within the housing 11, the edge of the printed circuit board 41 engages the intermediate portion 22*c* of the electrical contact 22 and deflects it from the intermediate orientation shown in FIG. 4 to the final position illustrated in FIG. 5. In this final position, the second portion 22*b* of the electrical contact 22 engages the electrically conductive trace 32 provided on the provided on the flat flexible conductor 31. At the same time, the intermediate portion 22*c* of the electrical contact 22 engages the electrically conductive trace 42 provided on the printed circuit board 41. Therefore, an electrically conductive connection is provided by the second portion 22*c* of the electrical contact 22 between the electrically conductive trace 32 provided on the flat flexible conductor 31 and the electrically conductive trace 42 provided on the printed circuit board 41. It will be appreciated that the same electrically conductive connection is provided between each of the other electrically conductive traces 32 provided on the flat flexible conductor 31 and their respective electrically conductive traces 42 provided on the printed circuit board 41.

Figure 6:
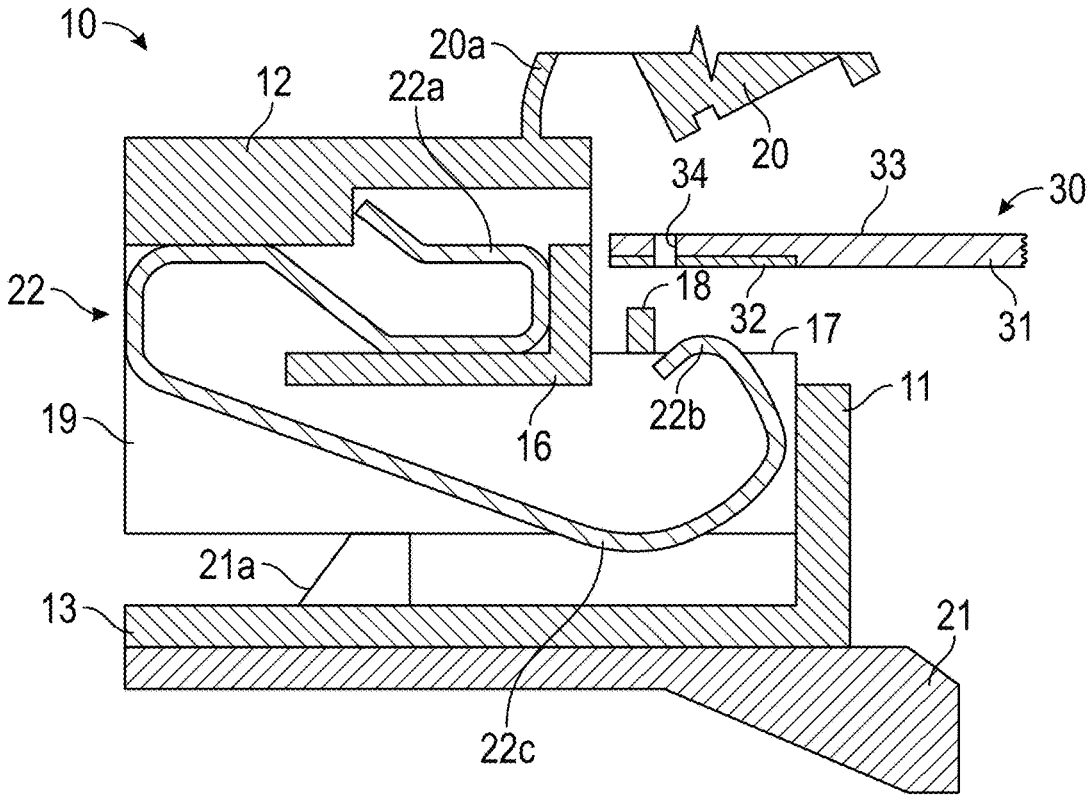
FIG. 6 is a side sectional elevational view of a second embodiment of the electrical connector assembly illustrated in FIGS. 1 and 2 shown in an initial stage of assembly.
Figure 7:
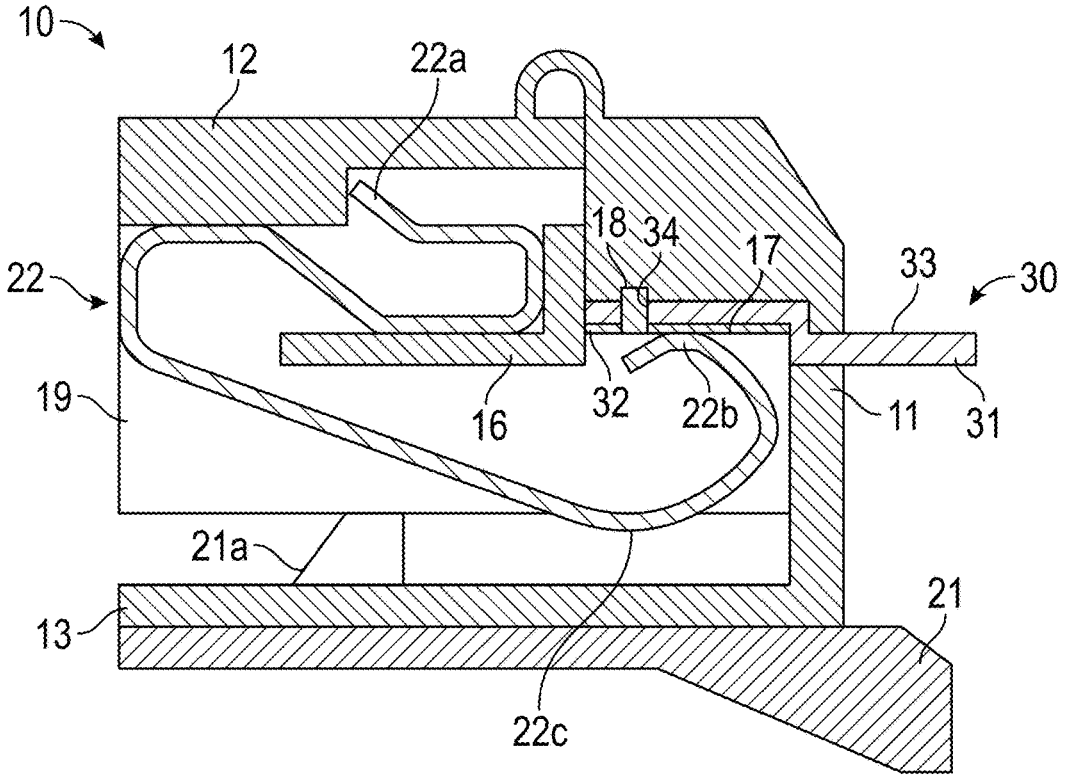
FIG. 7 is a side sectional elevational view of the second embodiment of the electrical connector assembly illustrated in FIG. 6 shown in an intermediate stage of assembly.
Figure 8:
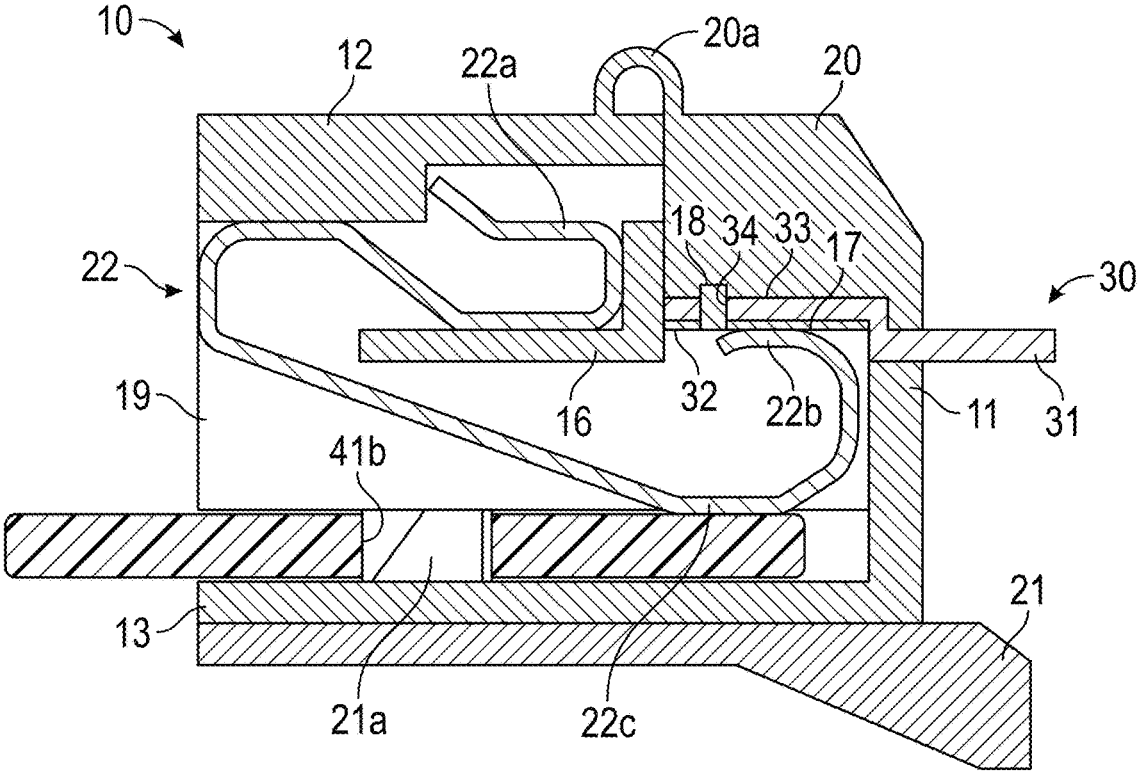
FIG. 8 is a side sectional elevational view of the second embodiment of the electrical connector assembly illustrated in FIG. 7 shown in a final stage of assembly.

FIGS. 6, 7, and 8 illustrate a second embodiment of the electrical connector assembly 10 of this invention. The second embodiment of this invention is, in large measure, identical to the first embodiment of this invention, and like reference numbers are used to indicate similar components. As shown in FIG. 6, each of the electrical contacts 22 is initially inserted into an associated one of the slots provided in the interior space of the housing 11. When so inserted, the first contact portion 22*a* of the electrical contact 22 is received within a space defined between the upper panel 12 and the interior panel 16 of the housing 11. If desired, an end of the first contact portion 22*a* may be sized and shaped to abut a portion of the upper panel 12 so as to positively retain the electrical contact 22 within the interior of the housing 11 following insertion, although such is not required. In the second embodiment of this invention, however, the intermediate contact portion 22*c* of the electrical contact 22 does not initially abut the upper surface of the lower panel 13 of the housing 11 when inserted within the interior of the housing 11. Also, the second contact portion 22*b* of the electrical contact 22 extends adjacent to the retainer 18, but about the level of the support surface 17 of the housing 11.

FIGS. 6, 7, and 8 illustrate a second embodiment of the electrical connector assembly 10 of this invention in various stages of assembly with the first electrically conductive structure 30 and the second electrically conductive structure 40. Initially, the locking arm 20 of the housing 11 is positioned in the unlocked position, as shown in FIG. 6. Also, the connector position assurance mechanism 23 is initially disposed in the unlocked position shown in FIG. 1. Then, an end of the first electrically conductive structure 30 is disposed adjacent to the support surface 17 and the retainer 18 of the electrical connector assembly 10, as also shown in FIG. 6. In this initial orientation, the opening 34 formed through the flat flexible conductor 31 is preferably aligned with the retainer 18 provided on the electrical connector assembly 10.

Then, as shown in FIG. 7, the end of the flat flexible conductor 31 is moved downwardly into engagement with the support surface 17 provided on the housing 11 of the electrical connector assembly 10. To accomplish this, the flat flexible conductor 31 is moved such that the opening 34 formed therethrough is disposed about the retainer 18 provided on the support surface 17 of the housing 11. Thereafter, the locking arm 20 is moved from the unlocked position to the locked position, as also shown in FIG. 7. Cooperating locking structures (not shown) may be provided on the locking arm 20 and the housing 11 to retain the locking arm 20 in the locked position, although such is not required. When located in this locked position, the locking arm 20 positively retains the flat flexible conductor 31 in engagement with the electrical connector assembly 10.

At this intermediate stage of assembly of the second embodiment, the second portion 22*b* of the electrical contact 22 engages the electrically conductive trace 32 provided on the flat flexible conductor 31. Therefore, an electrically conductive connection is provided between the second portion 22*c* of the electrical contact 22 and the electrically conductive trace 32 provided on the flat flexible conductor 31. At the same time, the intermediate portion 22*c* of the electrical contact 22 is moved downwardly, but not necessarily into engagement with the upper surface of the lower panel 13 of the housing 11.

Next, as shown in FIG. 8, the edge of the printed circuit board 41 is inserted within the housing 11 of the electrical connector assembly 10. To accomplish this, the left panel 14 and the right panel 15 of the housing 11 are respectively inserted within the slots 41*a* provided in the edge of the printed circuit board 41. When the printed circuit board 41 has been fully inserted within the housing 11, the projections 21*a* provided on the retention plate 21 are received within the openings 41*b* formed through the printed circuit board 41, as shown in FIGS. 1 and 8. Lastly, the connector position assurance mechanism 23 is moved from the unlocked position shown in FIG. 1 to the locked position shown in FIG. 2. As a result, the housing 11 of the electrical connector assembly 10 is positively retained on the printed circuit board 41.

As the printed circuit board 41 is inserted within the housing 11, the edge of the printed circuit board 41 engages the intermediate portion 22*c* of the electrical contact 22 and deflects it from the intermediate orientation shown in FIG. 7 to the final position illustrated in FIG. 8. In this final position, the second portion 22*b* of the electrical contact 22 continues to engage the electrically conductive trace 32 provided on the provided on the flat flexible conductor 31. At the same time, the intermediate portion 22*c* of the electrical contact 22 engages the electrically conductive trace 42 provided on the printed circuit board 41. Therefore, an electrically conductive connection is provided by the second portion 22*c* of the electrical contact 22 between the electrically conductive trace 32 provided on the flat flexible conductor 31 and the electrically conductive trace 42 provided on the printed circuit board 41. It will be appreciated that the same electrically conductive connection is provided between each of the other electrically conductive traces 32 provided on the flat flexible conductor 31 and their respective electrically conductive traces 42 provided on the printed circuit board 41.

The principle and mode of operation of this invention have been explained and illustrated in its preferred embodiments. However, it must be understood that this invention may be practiced otherwise than as specifically explained and illustrated without departing from its spirit or scope.

What is claimed is:

1. An electrical connector assembly comprising:

a housing having a slot defined therein and a space defined within the slot by two portions of the housing; and an electrical contact disposed within the slot and including:

a first portion disposed with the space and engaged with the two portions of the housing so as to positively retain the electrical contact within the slot of the housing and thereby prevent removal of the first portion from the space without deformation of the first portion, a second portion adapted to engage a first electrically conductive structure when inserted within the housing, and an intermediate portion, wherein the electrical contact extends from the first portion and through the intermediate portion to the second portion and is adapted to engage a second electrically conductive structure when inserted within the housing.

2. The electrical connector assembly defined in claim 1 wherein the housing has a plurality of slots defined therein and a space defined within each of the slots by two portions of the housing, and wherein an electrical contact is disposed within each of the plurality of slots, each electrical contact including a first portion disposed with the associated space and engaged with the two portions of the housing so as to positively retain the electrical contact within an associated one of the plurality of slots of the housing, a second portion adapted to engage the first electrically conductive structure when inserted within the housing, and an intermediate portion located between the first portion and the second portion and adapted to engage the second electrically conductive structure when inserted within the housing.

3. The electrical connector assembly defined in claim 1 wherein the housing includes a retainer that is adapted to engage the first electrically conductive structure when inserted within the housing.

4. The electrical connector assembly defined in claim 1 wherein the housing includes a locking arm that is adapted to engage the first electrically conductive structure when inserted therein.

5. The electrical connector assembly defined in claim 4 wherein the locking arm is connected to the housing by a living hinge.

6. The electrical connector assembly defined in claim 1 wherein the housing includes a retainer and a locking arm that are both adapted to engage the first electrically conductive structure when inserted within the housing.

7. The electrical connector assembly defined in claim 1 further including a retention plate secured to the housing and adapted to retain the second electrically conductive structure on the housing.

8. The electrical connector assembly defined in claim 7 wherein the retention plate has one or more projections provided thereon.

9. The electrical connector assembly defined in claim 1 wherein the first portion of the electrical contact is sized and shaped to engage the housing in such a manner as to positively retain the electrical contact within the slot of the housing.

10. An assembly comprising:

an electrical connector assembly including a housing having a slot defined therein and a space defined within the slot by two portions of the housing and an electrical contact disposed within the slot, the electrical contact including:

a first portion disposed with the space and engaged with the two portions of the housing such that the two portions of the housing positively retain the electrical contact within the slot of the housing and thereby prevent removal of the first portion from the space without deformation of the first portion, a second portion, and an intermediate portion, wherein the electrical contact extends from the first portion and through the intermediate portion to the second portion;

a first electrically conductive structure including a portion that extends within the housing and is engaged with the second portion of the electrical contact; and a second electrically conductive structure including a portion that extends within the housing and is engaged with the intermediate portion of the electrical contact.

11. The assembly defined in claim 10 wherein the housing has a plurality of slots defined therein and a space defined within each of the slots by two portions of the housing, and wherein an electrical contact is disposed within each of the plurality of slots, each electrical contact including a first portion disposed with the associated space and engaged with the two portions of the housing so as to positively retain the electrical contact within an associated one of the plurality of slots of the housing, a second portion engaged with the first electrically conductive structure, and an intermediate portion located between the first portion and the second portion and engaged with the second electrically conductive structure.

12. The assembly defined in claim 10 wherein the housing includes a retainer that is engaged with the first electrically conductive structure.

13. The assembly defined in claim 10 wherein the housing includes a locking arm that is engaged with the first electrically conductive structure.

14. The assembly defined in claim 13 wherein the locking arm is connected to the housing by a living hinge.

15. The assembly defined in claim 10 wherein the housing includes a retainer and a locking arm that are both engaged with the first electrically conductive structure.

16. The assembly defined in claim 10 further including a retention plate secured to the housing and retains the second electrically conductive structure on the housing.

17. The assembly defined in claim 16 wherein the retention plate has one or more projections provided thereon.

18. The assembly defined in claim 10 wherein the first portion of the electrical contact is sized and shaped to engage the housing in such a manner as to positively retain the electrical contact within the slot of the housing.

* * * * *